US007708039B2

(12) United States Patent
Pallmann

(10) Patent No.: US 7,708,039 B2
(45) Date of Patent: May 4, 2010

(54) CHIPPING APPARATUS HAVING AN ADJUSTABLE CUTTING ANGLE

(75) Inventor: Hartmut Pallmann, Zweibruecken (DE)

(73) Assignee: Pallmann Maschinenfabrik GmbH & Co. KG

( * ) Notice: Subject to any disclaimer, the term of this patent is extended or adjusted under 35 U.S.C. 154(b) by 145 days.

(21) Appl. No.: 10/849,811

(22) Filed: May 21, 2004

(65) Prior Publication Data

US 2004/0250899 A1 Dec. 16, 2004

(30) Foreign Application Priority Data

May 22, 2003 (DE) ..... 103 23 769

(51) Int. Cl.
*B27C 1/00* (2006.01)

(52) U.S. Cl. ..... 144/162.1; 144/176; 144/218; 144/230

(58) Field of Classification Search ..... 241/85, 241/91, 291; 451/45, 122; 144/162.1, 174–176, 144/218, 230, 235
See application file for complete search history.

(56) References Cited

U.S. PATENT DOCUMENTS 861,368 A * 7/1907 Juengst ..... 407/49
995,024 A * 6/1911 Mitchell ..... 144/230
3,266,539 A * 8/1966 Gantt ..... 144/176
3,559,705 A * 2/1971 Salzmann, Jr. ..... 144/162.1
4,047,670 A * 9/1977 Svensson ..... 241/92
4,503,895 A * 3/1985 Arasmith ..... 144/373
5,211,688 A * 5/1993 Rice, Sr. ..... 144/373
5,217,424 A * 6/1993 Pallmann ..... 483/1
5,409,047 A * 4/1995 Jorgensen ..... 144/176
5,823,856 A * 10/1998 Pallmann ..... 451/45
2002/0170992 A1 11/2002 Pallmann

FOREIGN PATENT DOCUMENTS

| | | |
|---|---|---|
| CA | 2132876 | 9/1993 |
| DE | 198 48 233 A1 | 10/1999 |
| DE | 100 48 886 A1 | 4/2002 |
| DE | 101 25 922 A1 | 11/2002 |
| WO | WO 93/18896 | 9/1993 |

* cited by examiner

*Primary Examiner*—Bena Miller
(74) *Attorney, Agent, or Firm*—Muncy, Geissler, Olds & Lowe, PLLC

(57) ABSTRACT

An apparatus for chipping material, particularly wood, includes a plurality of knife carriers are arranged around a mutual axis that form the boundaries of a cutting chamber while forming a comminution path. On the knife carriers, the slicing knives, under inclusion of a cutting angle δ, are detachably attached to the comminution path. The blades of the slicing knives uniformly project into the cutting chamber. To adjust the cutting angle δ so as to adapt it to the prevailing conditions, a control element for determining the cutting angle δ is detachably arranged between the slicing knives and the knife carriers.

22 Claims, 4 Drawing Sheets

CHIPPING APPARATUS HAVING AN ADJUSTABLE CUTTING ANGLE

This nonprovisional application claims priority under 35 U.S.C. §119(a) on German Patent Application No. 103 23 769.0-23 filed in Germany on May 22, 2003, which is herein incorporated by reference.

BACKGROUND OF THE INVENTION

1. Field of the Invention

The present invention relates to an apparatus for chipping materials having an adjustable cutting angle.

2. Description of the Background Art

Devices of this class are known from a wide variety of models. DE 101 25 922 A1, for example, has a knife ring chipper for timber. Its chipping unit has a chipping chamber around which a ring of knives are arranged. The chipping unit includes two ring wheels, which are concentrically arranged around an axis of rotation, the ring wheels being connected to axis-parallel knife carriers, which are distributed around a perimeter of the ring wheels in a circular fashion. With their base facing the axis of rotation, the knife carriers form the boundary of the chipping chamber. Due to the spacing between the knife carriers, axis-parallel slots are formed. Each knife carrier has a bearing surface that is angled towards its base for an accurate incorporation of the slicing knife. In this position, the slicing knife extends through the axial slot with a predetermined blade length projecting into the chipping chamber, and with the backside of the preceding knife carrier forms a comminution channel for the passage of the chipped material. The angle of inclination between the slicing knife and the base of the knife carrier is equal to the cutting angle, which typically is in the range of approximately 30° to 45° and is immutably determined by the geometry of the knife carrier.

A similar device is known from DE 198 48 233 A1, which also discloses a knife ring chipper, and in which small-particle material is fed in an airflow to the knife ring. For the comminution of the material, a striker wheel acts jointly with the knife ring, both of which rotate in opposite directions and thus move the small-particle material past the blades of the slicing knives. Apart from counter-rotating chipping tools, simpler models are also known, whereby the knife ring is stationary and only the striker wheel rotates, or whereby only the knife ring rotates and the blades are moved past a stationary counter-knife. All of these devices have in common that the structure of the knife ring is basically as previously described, in particular, that the knife carriers have a rigid bearing surface for the slicing knives that determines the cutting angle.

Conventional cutting disks have a comminution unit that includes a rotating disk with an opening that is arranged in a semi-radial direction along which the knife carriers with slicing knives are arranged. The knife carriers, in turn, have a bearing surface that is inclined towards the disk plane for attaching the slicing knife, whose inclination determines the cutting angle. Such a cutting disk is known from DE 100 48 886 C1, for example, wherein a cutting disk is used in a first stage of comminution. The special feature of this device is the combination with a second stage of comminution, which is formed from a ring of knives as previously described.

All of the conventional art previously described have in common that the position of the slicing knife in relation to the chipping chamber, and therefore the cutting angle, are immutably determined by the fixed geometry of the knife carrier. In many areas of application, this constant cutting angle may be sufficient. However, increased demands regarding the quality of the chips and the economical operation of comminution devices make it imperative to continue to improve devices of this class.

SUMMARY OF THE INVENTION

It is therefore an object of the present invention to improve the quality of the chips while simultaneously increasing the efficiency of the chipping apparatus.

The invention is based on the idea to adjust a cutting angle of a chipping apparatus, based on prevailing conditions, by arranging a control element between a slicing knife and a knife carrier. This is accomplished by designing the control element in such a way that its two surfaces incline towards each other. Preferably, the shape of the control element is always the same. Therefore, for each inclination change, a suitable set of control elements is available, with which all knife carriers of a knife ring and/or a cutting disk can be fitted.

The prevailing conditions depend in a large measure on the characteristics of the material that is to be processed. For example, if the material are tree trunks, the type of wood is the deciding factor for the comminution process since the type of wood determines the physical characteristics of the material. Essential factors are the hardness and moisture content of the wood, the time of year when the trees were logged (summer or winter wood), fast or slow growth of the trees, freshly-cut or stored wood, etc.

Machine-dependent factors, which influence the chipping process, are first of all an engagement direction of the chipping tools, namely vertical or parallel to the direction of the grain, the possibility of chip removal, as well as the required chip quality and chip geometry. Additional factors are the maximum energy input and the comminution output resulting therefrom, as well as the maximum permissible temperature during the chipping process.

Using a control element specially designed for the characteristics of the material to be processed allows for an optimal adjustment of the cutting angle, which sets the best possible conditions for the comminution process. From the equipment side, this computes into lower energy use and reduced wear and tear, which reduces the need for replacement parts, lowers maintenance costs and energy demands. Altogether, there is less wear and tear during the comminution process on a chipping device that is optimally tuned.

With respect to the final product, a substantially increased chip quality can be observed. The right cutting conditions lead to smooth chip surfaces and overall uniform size. This material is especially well suited for the production of high-quality intermediate products like, for example, OSB boards (Oriented Strand Boards), which are strewn on a band and are glued together, under high pressure, in the direction of the grain and with as few minute particles as possible.

According to a beneficial embodiment of the invention, the control element is plate-shaped in order to provide the slicing knife or the knife package as great of a large-surface support as possible. Through the non-parallelity of the upper side and the lower side of the plate-shaped control element, a wedge shape is formed that leads to a setting of a cutting angle $\delta$ depending on the degree of the mutual inclination $\epsilon$. This non-parallel nature can be such that the control element's profile is tapered towards the chipping chamber. In this way, the cutting angle $\delta$ is increased by the degree of an angle $\epsilon$ starting at the inclination of the bearing surface of the knife carrier. The non-parallel feature can also lead to a steady widening of the control element's profile towards the chipping chamber. In this case, the cutting angle $\delta$ is decreased by the degree of the angle ϵ. In this way, by using a suitable control element, the best comminution conditions can be achieved for each application.

Depending on the prevailing conditions during the comminution process, particularly the characteristics of the feed material, a setting range of the angle δ of 20° to 50° using the control element of this invention is preferred to allow consideration of all possible areas of application. In some instances cutting angles δ ranging from 25° to 45° or even from 30° to 40° are also sufficient if the feed material in view of its characteristics do not vary too much.

Since the cutting angle δ is derived from the inclination of the knife carrier and the inclination ϵ of the control element's surfaces towards each other, by a customary knife carrier inclination of, for example, 35°, an angle ϵ ranging between 0° and 15° is desirable, a range of 0° and 10° is preferred, and a range of 0° and 5° is most preferred in order to achieve the above-mentioned ranges for the cutting angle δ.

To exchange the control elements, the control elements must be detached from the knife carrier. A screw connection is preferred therefor, which is simple in design and safe in operation. Additionally, according to a particularly beneficial embodiment of the invention, a toothing is formed in the contact surface between the control element and the knife carrier, for example, in the form of a nut and spring connection. The primary purpose of the toothing is to center the control element plate in relation to the knife carrier and to absorb additional forces in the contact surface.

When using knife packages that are composed of the slicing knife and the knife retaining plate, a partially gradated surface of the control element is preferred to achieve an adaptation to the contours of the knife package. In this way, the knife package is supported on the full surface of the control element.

When using the control element of this invention with a knife package or with only a slicing knife, it is beneficial to screw the control element to the knife package and/or the slicing knife. The unit resulting therefrom can be assembled outside of the knife ring so that there is no interruption in the comminution operation. The knife exchange itself is done by exchanging only the unit, which, when compared with a knife exchange without control elements, does not require additional time and, therefore, does not add to the down time caused by the changing out of knives.

Because the knife packages are to function with different control elements, it is beneficial to provide a backstop at a rearward longitudinal edge of the knife package that is adjustable horizontally to the edge and takes into account the changed geometry when the cutting angle δ is adjusted, and particularly takes the blade projection across from the base of the knife carrier into consideration.

By arranging receptacles for slitting elements, the chips produced with a device of this invention can be made of a predetermined length.

Through a change of the cutting angle δ a displacement of the blade of the slicing knife in relation to the knife ring occurs, thus pressure lips that are located in the direction of rotation at the rearward side of the knife carriers are exchangeable, according to a further advantageous embodiment this invention. By using a suitable pressure lip in combination with a certain control element, the cutting conditions for the operation of a chipping device can be further optimized.

The invention is explained in more detail below with an embodiment illustrated in the drawings. The embodiment shows a knife ring chipper for timber, without limiting the invention to this embodiment. The invention also includes knife ring chippers with stationary or rotating opposing knives as well as cutting disks, all of which have knife carriers, which hold a slicing knife in a predetermined cutting angle to the comminution material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
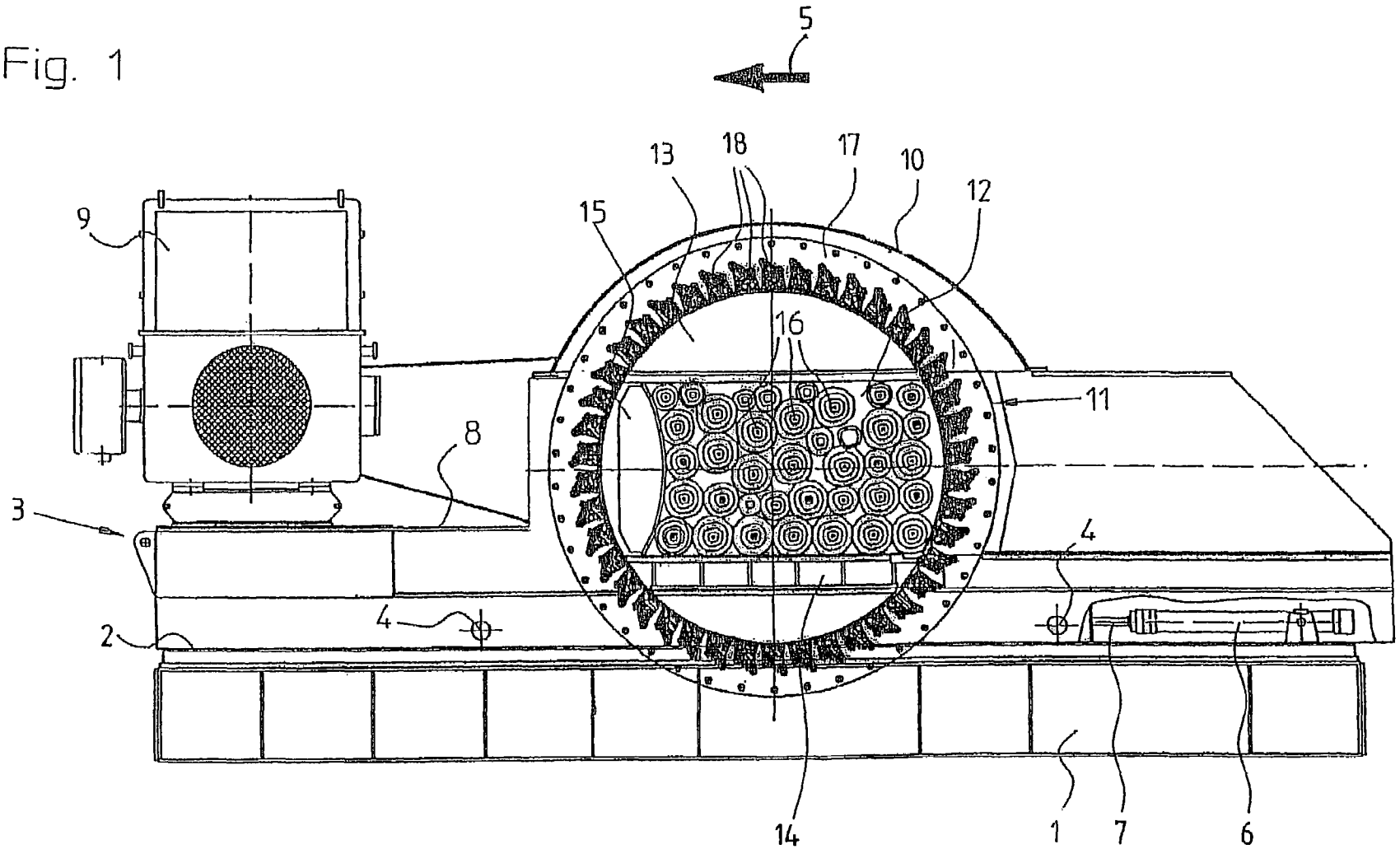
FIG. 1 is a schematic diagram of a chipping apparatus according to a preferred embodiment of the present invention.

FIG. 1 illustrates a knife ring chipper of this invention for chipping timber. To start with, there is shown a stationary substructure 1 having rails 2 arranged along its upper side in plan view. The rails 2 serve as a track for the base frame 3 of the engine, which is cross-slidingly arranged on wheels 4 in the direction of the arrow 5. A cylinder piston unit 6 is fixedly connected to the substructure 1, its moving piston 7 activating the base frame 3 of the engine, thus causing a lateral movement of the base frame 3 of the engine. Furthermore, the base frame 3 has a platform 8, which carries an electric motor 9.

Additionally, a hood-shaped housing 10 is attached to the base frame 3, which serves as a receptacle for a knife ring 11 that can be rotated freely around a horizontal axis. A rearward wall of the housing 10 is closed and serves as a storage place for a drive shaft (not shown) of the knife ring 11, the front of the housing 10 has a circular opening, through which the chipping chamber 12 is freely accessible. Towards its top, the chipping chamber 12 is bound by a circular arc segment 13, a bent side of which extends in close proximity to the knife ring 11. In the lower region, a bracing floor construction 14 forms the boundary of the chipping chamber 12 and is, like the circular arc segment 13, fixedly connected with the housing 10. The left boundary area of the chipping chamber 12, from an illustration view point, is formed by a counter-stop 15, which extends axially into the chipping chamber 12, is convex in cross section and is stationarily arranged opposite the substructure 1 of the apparatus and thus does not follow the lateral movements of the base frame 3 of the engine. The opposite side of the chipping chamber 12 is formed by a segment of the inner side of the knife ring 11 and forms a comminution path.

The material, which is in the form of logs 16, as well as the counter-stop 15, extend with an unencumbered part of their length axially into the chipping chamber 12. The part of the logs 16 located outside the chipping chamber 12 is in a feeder device (not shown), at which end it is firmly clamped together for the comminution process. Additionally, there are holding-down clamps (not shown) in the chipping chamber 12, which hold the logs 16 in place during the comminution process. The comminution of the logs 16 is done by lateral movement of the base frame 3 of the engine while the knife ring 11 is rotating, whereby the logs 16, due to the stationary counter-stop 15, are pressed against the comminution path where they are engaged by the chipping tools.

Figure 2:
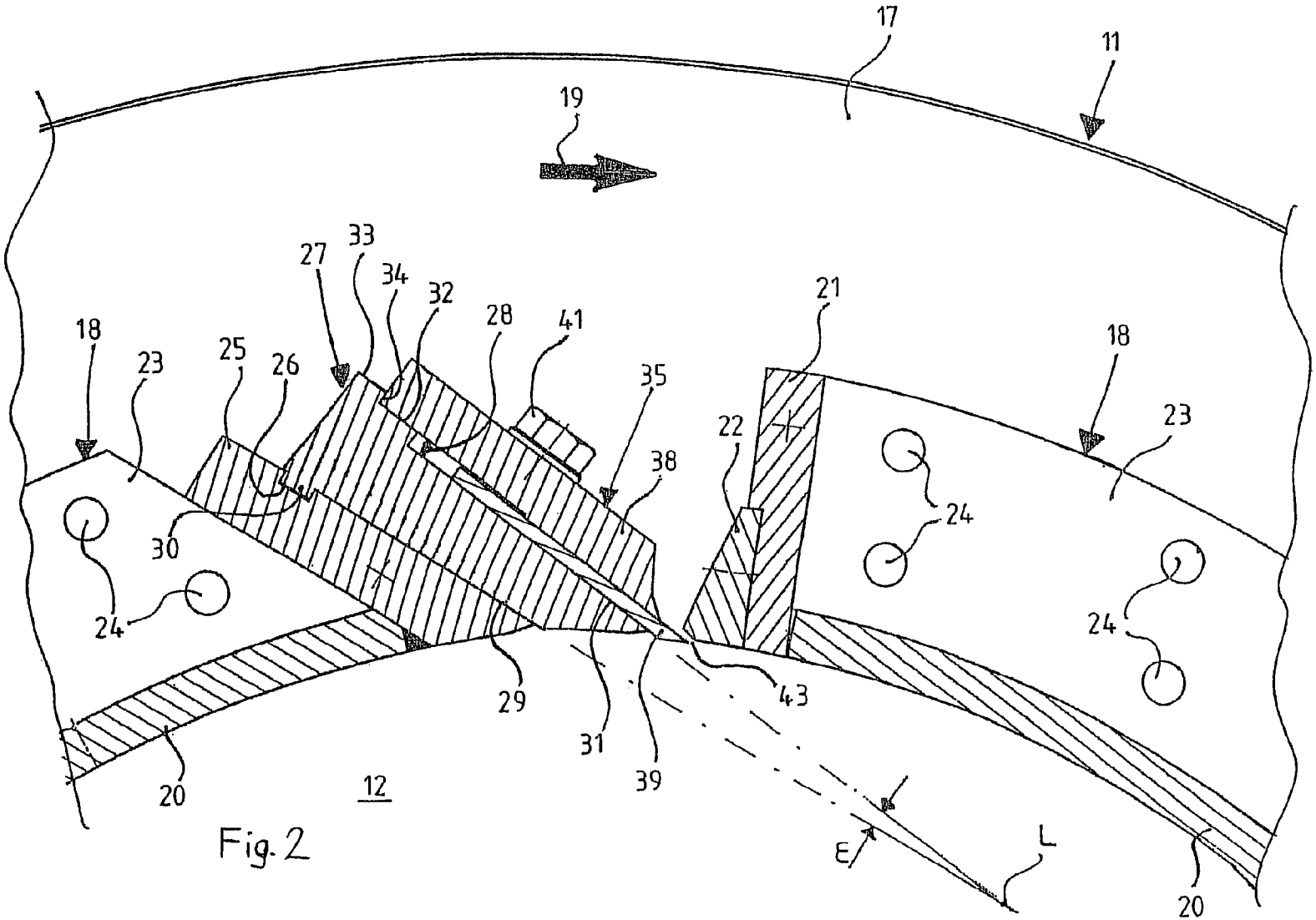
FIG. 2 is a partial cross-section of a knife ring of a the chipping apparatus according to the invention.

The knife ring 11 includes two concentric ring wheels arranged with a space there between, of which in FIGS. 1 and 2, due to the layout of the sectional view, only the rear one marked with the reference numeral 17 is visible. The inner sides of the two ring wheels are connected by axially-oriented knife carriers 18, which are evenly distributed around the perimeter, thereby resulting in a rigid knife ring 11 unit.

FIG. 2, illustrates a section of a knife ring 11. Again, the reference numeral 17 marks the hub-lateral ring wheel, from the inner side of which the knife carriers 18 extend perpendicular. The left half of the drawing shows, in the direction of rotation 19, the front part of a knife carrier 18, whereas the right half of the drawing illustrates the rear part of a preceding knife carrier 18, also in the direction of rotation 19.

The knife carrier 18 is box-shaped, whereby its bottom side is formed by a curved wear shoe 20 that forms a boundary of the chipping chamber 12. The rearward side of the knife carrier 18 is formed of a radially oriented wall element 21, to which a slat-shaped pressure lip 22 having a trapezoid cross section is screwed. Of the two sidewalls, only the one allocated to the rear ring wheel 17 and identified with the reference numeral 23 is visible. The two sidewalls 23 are rigidly connected to the ring wheels 17 by screws 24.

A front side of the knife carrier 18 is formed by a slanted base plate 25, which extends at an angle of approximately 35° tangentially to the chipping chamber 12. This results in a knife carrier 18 that is tapered in the direction of rotation 19 towards the chipping chamber 12. In the area of its longitudinal edge located across from the wear shoe 20, the base plate 25 has a longitudinal groove 26 extending vertically to the illustration plane. The parts forming the knife carrier 18 are all welded together and are made of wear-resistant materials, for example, Hardox 400. This results in an extremely robust and rigid construction.

As an alternative to the box-shaped design of the knife carrier 18, a massive type of construction with hardened or armor-plated parts being provided in zones with high wear and tear would also be possible.

Figure 3C:
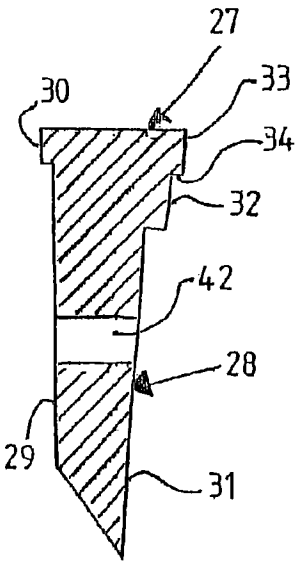
FIGS. 3*a*-3*c* are a top view and two cross sectional vies, respectively, of a control element illustrated in FIG. 2.
Figure 3B:
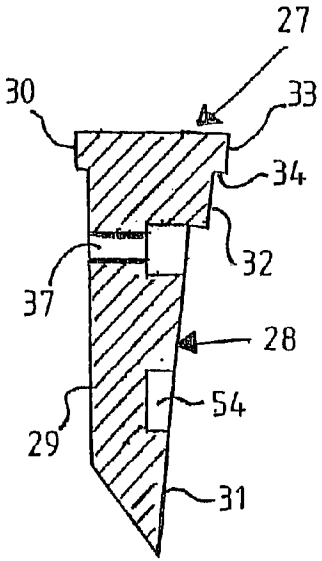
Figure 3A:
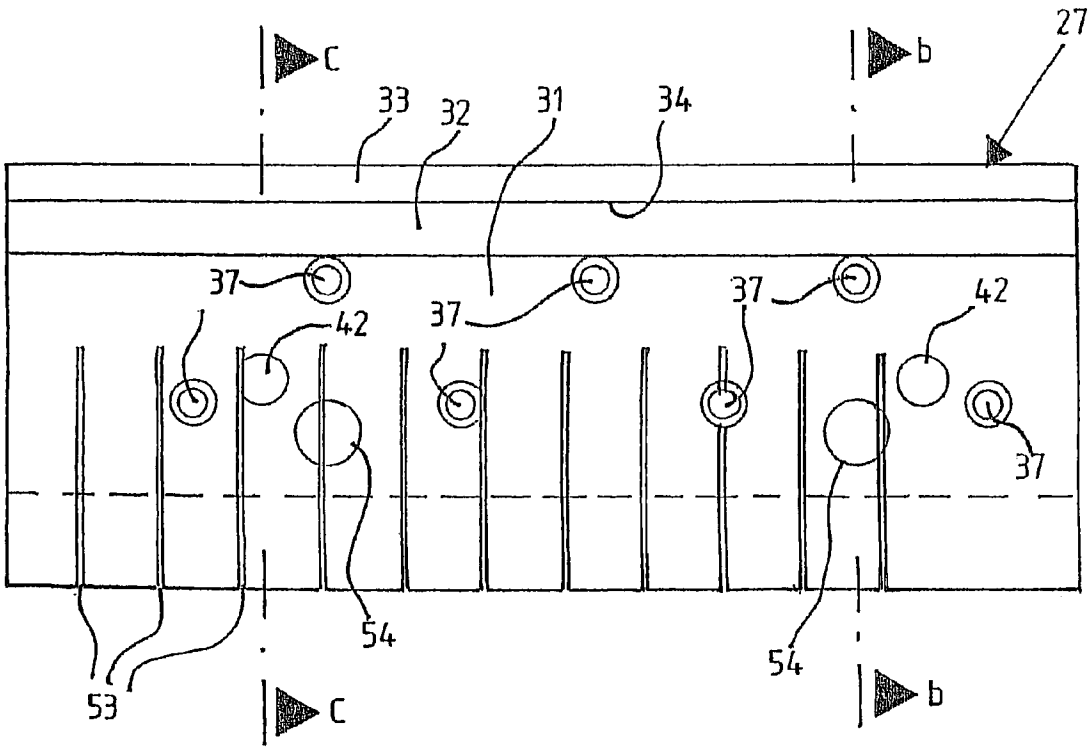

The base plate 25 forms a support surface for a control element 27, which in the illustrated embodiment includes a wedge-shaped plate with a top 28 and a bottom 29. A more detailed construction of the control element 27 is illustrated in FIGS. 3*a*-3*c*.

The bottom 29 of the control element 27 is formed so as to be flat in order to ensure as large a support surface as possible and features only at the rear longitudinal edge a slat-shaped projection 30, which, together with the longitudinal groove 26, creates a positive locking in the base plate 25. The function of this positive locking is both for a power derivation and for a centering of the control element 27. The top 28 of the control element 27 is gradated, the result of which is a first larger partial surface 31, a second striated partial surface 32, and finally, a third, also striated partial surface 33. The transition between the second partial surface 32 and the third partial surface 33 serves to form a stop surface 34. In this way, a surface profile is created, which is ideally suited for accommodating a knife package 35.

The wedge shape of the control element 27 is formed by the inclination of the top 28 compared to the bottom 29, which in the illustrated embodiment includes an angle $\epsilon$ of approximately 5°.

Figure 4:
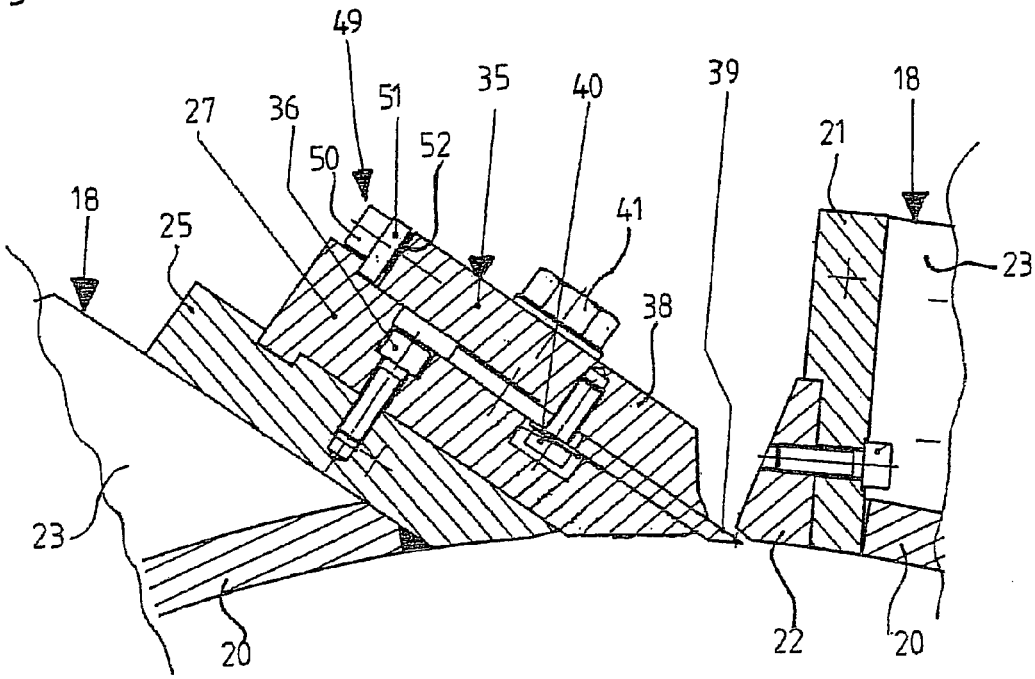
FIG. 4 is a cross section of a chipping apparatus according to an alternate embodiment of the invention.

The mounting of the control element 27 to the knife carrier 18 is done with the aid of screws 36, as illustrated in FIG. 4. Their distribution can be viewed in FIG. 3, where the arrangement of the bores 37 for the screws 36 is illustrated. Extensions of the bores 37 are found in screw thread bores in the base plate 25 (FIG. 4).

The top 28 of the control element 27 carries a knife package 35, which is formed by a knife retaining plate 38, onto which the slicing knife 39 is mounted with screws 40 (FIG. 4), which are adjustable within elongated holes, as is commonly known. This allows the adjustment of the knife package 35 to a predetermined width outside the knife ring 11.

When installed, the bottom side of the slicing knife 39 rests evenly on the first partial surface 31. The thickness of the slicing knife 39 is equal to the height differential to the second partial surface 32, and the heads of the screws 40 lie within grooves 54 (FIGS. 3 and 4) of the partial surface 31. As a result, the knife retaining plate 38 comes to rest evenly on the second partial surface 32. The knife retaining plate 38 pushes with its rear longitudinal edge against the stop surface 34, which forms a zero position for setting the projection of the slicing knife 39 into the chipping chamber 12. The knife package 35 is fastened with screws, which extend through the knife package 35 to threaded bores 42 in the control element 27 (FIG. 3).

In this way, in an operative mode, the slicing knives 39 are brought into a position that is parallel to the pressure lip 22, or slightly diverging and at a distance therefrom so that a passage slot 43 is created, through which the chipped material in the course of the comminution passes from the chipping chamber 12 to the peripheral areas of the knife ring 11.

Figure 5:
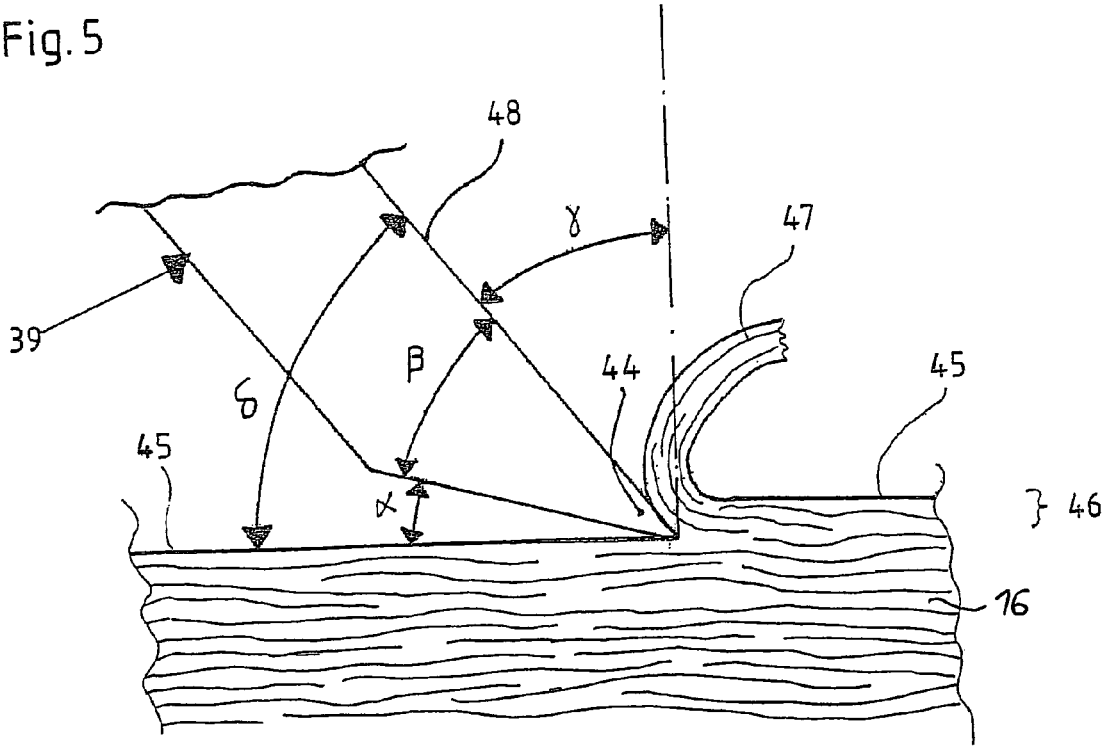
FIG. 5 is an illustration of a blade of a slicing knife.

FIG. 5 shows, in a simplified illustration, the chipping process. What can be seen is the tip of the slicing knife 39 with a blade 44 engaged in the processing of material in the form of wood, for example, a tree trunk 16. A top side 45 of the material corresponds thereby with the bottom part of the wear shoe 20 that bounds the chipping chamber 12. The projection 46 of the blade 44 of the slicing knife 39 beyond the bottom of the knife carrier 18 defines the thickness of the chip 47 to be cut.

During the chipping process, the following geometric relations and angle designations occur. Enclosed by a back 48 of the slicing knife 39 and a perpendicular to the top 45 of the material is an angle of the chip $\gamma$. The angle formed by the back 48 of the slicing knife 39 and the top 45 of the material is referred to as cutting angle $\delta$; the tapering angle of the blade 44 is referred to as wedge angle $\beta$. Between the blade 44 and the top 45 of the material, setting angle $\alpha$ arises.

As can be easily seen in FIG. 2, with knife ring chippers and also with disk cutters, the cutting angle $\delta$ is formed by the inclination of the base plate 25 and the additional inclination of the slicing knife 39 that is determined by the shape of the control element 27, the inclination in the illustrated embodiment being formed by the wedge shape. The wedge shape is created by the inclination in opposite directions of the top 28 and bottom 29 of the control element 27, which include an angle $\epsilon$ and thereby form a joint cutting line L. In the embodiment illustrated in FIG. 2, the cutting line L is inside the chipping chamber 12 with the result that the cutting angle $\delta$, which is determined by the base plate 25 of the knife carrier 18, is increased by the measure $\epsilon$.

For other application purposes, the wedge shape of the control element 27 can be tapered in the opposite direction so that the cutting line L lies outside of the chipping chamber 12. In this instance, the cutting angle $\delta$ is decreased by the measure $\epsilon$.

A third possibility is illustrated in FIG. 4, whereby the top 28 and bottom 29 of the control element 27 extend parallel to one another and thus do not form a cutting line L. In this case, the cutting angle $\delta$ is equal to the inclination angle of the base plate 25 to the bottom of the wear shoe 20.

In this way, by using a suitable control element 27, it is possible to adjust the cutting angle $\delta$ to the prevailing conditions with respect to material, chip geometry, chip quality etc. without having to exchange the complete knife ring 11.

FIG. 4 shows a modified embodiment of the invention, whereby, as previously mentioned, the control element 27 does not alter the cutting angle δ determined by the knife carrier 18 due to the top 28 extending parallel to the bottom 29.

In comparison to the embodiment of the invention illustrated in FIG. 2, the modified version in FIG. 4 has an adjustable backstop 49 on the rearward longitudinal edge of the knife retaining plate 38. The adjustable backstop 49 includes a screw 50 with a stop surface 34 concurring with a disk 51, which can be screwed into the rearward longitudinal side of the knife retaining plate 38. Preferably, such an adjustable backstop 49 is arranged in two separate locations on the knife retaining plate 38.

Between the disk 51 and the longitudinal edge of the knife retaining plate 38, a predetermined number of thin inlay lamellae 52 is inserted. The number of the inlay lamellae 52 thereby determines the relative position of the disk 51 with respect to the knife retaining plate 38 and thus determines the position of the backstop 49. Thus, an adjustment of the knife package 35 to differently shaped control elements 27 and the varying geometry resulting therefrom can be achieved in a simple way.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for chipping material, the apparatus comprising:

a plurality of knife carriers that are arranged around a mutual axis thereby forming a boundary of a cutting chamber and a comminution path;

at least one slicing knife having a blade thereof uniformly protruding into the cutting chamber to thereby form a cutting angle δ; and a control element being provided between the slicing knife and at least one of the plurality of knife carriers, the control element determining the cutting angle δ, the slicing knife being detachably attached to the control element, wherein the control element has a bottom side facing the knife carriers and a top side facing the slicing knife, and wherein the top side is inclined towards the bottom side and the bottom side is inclined towards the top side.

2. The apparatus according to claim 1, wherein the plurality of knife carriers are arranged in parallel on a peripheral line about the mutual axis and are arranged in even tangential spaces to form a ring of knives having a drum-shaped comminution path.

3. The apparatus according to claim 2, wherein the plurality of knife carriers are arranged rotatably around the mutual axis so that the blades of the slicing knives form a mutual blade rotation circle.

4. The apparatus according to claim 1, wherein the plurality of knife carriers are arranged radially and concentrically to the mutual axis to form a disk-shaped or ring shaped comminution path.

5. The apparatus according to claim 1, wherein the control element is plate-shaped wherein the top side and the bottom side are inclined towards each other about an angle ϵ, and wherein the top side and the bottom side are inclined such that they taper towards the mutual axis.

6. The apparatus according to claim 5, wherein the angle ϵ and an inclination of the knife carrier form a cutting angle δ of 20° to 50°.

7. The apparatus according to claim 5, wherein the angle ϵ is between 0° and 15°.

8. The apparatus according to claim 1, wherein the control element is detachably attached to at least one of the plurality of knife carriers.

9. The apparatus according to claim 1, wherein the control element has at feast one interlocking tooth formed on a contact surface with the at least one of the plurality of knife carriers to interlock the control element to the at least one of the plurality of knife carriers.

10. The apparatus according claim 1, wherein the slicing knife forms a knife package that is connected to a knife retaining plate, wherein a top side of the control element is gradated thereby forming at least two partial surfaces, a first partial surface forming a contact surface with the slicing knife and a second partial surface forming a contact surface with the knife retaining plate, and wherein the degree of gradation approximately equals a thickness of the slicing knife.

11. The apparatus according to claim 1, wherein an edge of the control element faces away from the blade of the slicing knife and has a backstop for a respective edge of the slicing knife or a knife-retaining plate.

12. The apparatus according to claim 10, wherein the knife packages have an adjustable stop extending horizontally of a longitudinal direction of the knife packages, the stop interacting with a stop surface of the control element.

13. The apparatus according to claim 10, wherein the slicing knife or the knife package is screwed to the control element.

14. The apparatus according to claim 1, wherein the control element has receptacles for attaching slitting elements.

15. The apparatus according to claim 1, wherein the slicing knife, together with a pressure lip, which precedes the slicing knife in the direction of rotation, form a passage slot for chipped material, the pressure lip being detachably attached to a side of a preceding knife carrier that is transverse to the slicing knife.

16. The apparatus according to claim 1, wherein a knife ring is formed of the plurality of knife carriers, each of the knife carriers having the slicing knife and the control element.

17. The apparatus according to claim 1, wherein a cutting disk is formed of the plurality of knife carriers, each of the knife carriers having the slicing knife and the control element.

18. The apparatus according to claim 1, wherein the material is wood.

19. The apparatus according to claim 5, wherein the angle ϵ and an inclination of the knife carrier form a cutting angle δ of 25° to 45°.

20. The apparatus according to claim 5, wherein the angle ϵ and an inclination of the knife carrier form a cutting angle δ of 30° to 40°.

21. The apparatus according to claim 5, wherein the angle ϵ is between 0° and 10°.

22. The apparatus according to claim 5, wherein the angle ϵ is between 0° and 5°.

* * * * *